United States Patent [19]

Scannell, Jr.

[11] Patent Number: 5,057,046

[45] Date of Patent: Oct. 15, 1991

[54] FLOTATION DEVICE PERIPHERAL SYSTEM

[76] Inventor: Robert F. Scannell, Jr., 500-2B Auten Rd., Somerville, N.J. 08876

[21] Appl. No.: 502,453

[22] Filed: Mar. 30, 1990

[51] Int. Cl.[5] ..... B63C 9/12

[52] U.S. Cl. ..... 441/106; 441/112; 441/118

[58] Field of Search ..... 441/88, 102, 103, 106, 441/107, 108, 109, 110, 111, 112, 113, 114, 115, 116, 117, 118, 119

[56] References Cited

U.S. PATENT DOCUMENTS

| | | | |
|---|---|---|---|
| 3,068,500 | 12/1962 | Silverman et al. | 441/118 |
| 3,103,674 | 9/1963 | Ondrush et al. | 441/118 |
| 3,266,070 | 8/1966 | O'link | 441/112 |
| 3,475,774 | 11/1969 | Hawkins | 441/118 |
| 4,167,051 | 9/1979 | Galecke . | |
| 4,418,733 | 12/1983 | Kallman | 383/11 |
| 4,545,773 | 10/1985 | Evert | 441/114 |
| 4,626,221 | 12/1986 | Rocco | 441/108 |
| 4,694,772 | 9/1987 | Faulconer et al. | 441/112 |
| 4,740,183 | 4/1988 | McKenzie | 441/104 |
| 4,889,511 | 12/1989 | Herman | 441/106 |

FOREIGN PATENT DOCUMENTS

| | | | |
|---|---|---|---|
| 1957507 | 3/1977 | Fed. Rep. of Germany . | |
| 18005 | 11/1908 | United Kingdom | 441/107 |
| 2032854 | 5/1980 | United Kingdom . | |
| 2068846 | 8/1981 | United Kingdom . | |

OTHER PUBLICATIONS

*Boat/U.S. Equipment Catalog: 1989 Annual*, pp. 1 and 19.

*E&B Discount Marine* catalog, pp. 1, 14 and 16.

*Primary Examiner*—Sherman D. Basinger
*Assistant Examiner*—Stephen P. Avila
*Attorney, Agent, or Firm*—Kenneth P. Glynn

[57] ABSTRACT

The present invention, in it several embodiments, provides a harness-type structure for securing equipment, pouches, mountings of safety harnesses to, but not limited to, a personal flotation device in a compact, easily accessible system. The invention is adaptable for use with various types of clothing devices and carrying devices, a preferred such device being a personal flotation device, and where the wearer wishes to expand the capabilities of these devices for carrying or supporting valuables, accessory equipment, or emergency equipment.

26 Claims, 5 Drawing Sheets

FLOTATION DEVICE PERIPHERAL SYSTEM

This invention relates generally, but is not limited, to the field of personal flotation devices. More particularly, this invention relates to an element for attaching equipment or valuables to various types of vests, such as diving vests and hunting vests; coats, such as overcoats, parkas and raincoats; luggage, such as duffel bags, handbags, briefcases, suitcases, back packs, shoulder packs, fanny packs and garment bags; and personal flotation devices in a compact, easily accessible system.

BACKGROUND OF THE INVENTION

The personal flotation device (PFD) has been developed for use in a wide variety of activities. Typically, such devices include at least a buoyant body portion and an element for securing the device to the body of the wearer. The U.S. Coast Guard classifies Approved PFDs in five categories: Type I - "Offshore Life Jacket", for use in open or rough water where rescue may be slow; Type II - "Near-Shore Buoyant Vest", for use in areas where water is relatively calm and rescue should be fast; Type III - "Flotation Aid" for use in calm inland water where rescue should be fast; Type IV - "Throwable Device"; and Type V - "Hybrid Device", which must be worn at all times to be considered approved. In addition, PFDs have been specialized for use in a wide variety of water sports, including sailboarding, fishing, and skiing In many situations, it is advisable or prudent for the wearer to carry equipment such as emergency gear and valuables. While some PFDs are equipped with integral pockets or compartments, most are not. Those that are so equipped are often the expensive, "Type V - Hybrid devices" which must be worn at all times to be considered an "approved device" by the U.S. Coast Guard, and are not adapted for use in many situations, such as where the water will be rough and rescue may be slow. Those PFDs and other items identified above that are equipped with integral pockets or compartments have limited capacity for storing or supporting equipment or valuables in a compact and easily accessible fashion due to the limited size and quantity of those integrated pockets or compartments. These items lack adequate provision for accomodating additional equipment in a compact manner.

It is therefore an object of the invention to provide elements for attaching equipment to a PFD in a compact, easily accessible system. It is another object of the invention to provide an element for attaching a pouch or equipment which is not integral with the PFD and is adaptable for almost any vest or collar-type flotation device of Types I–III. A further object of the invention is to provide a PFD adapted to releasably attach equipment, a pouch for holding the equipment, a mounting, and/or a security harness. A still further object of the invention is to provide a system for attaching equipment to a personal flotation device and other items as stated above by adapting these items by substantially permanently ataching the system at a selected location on each item and securing equipment thereto.

Other objects of the invention will in part be obvious and will in part appear hereafter.

SUMMARY OF THE INVENTION

One embodiment of the present invention is a harness for attaching a pouch, mounting, or equipment to a personal flotation device, where the harness itself has a support backing and a first attaching strap secured to the support backing. The attaching strap is adapted to encircle and fasten about one side of a PFD. The harness has an anchoring strap fastened to a first edge of the support backing, which is adapted to encircle one side of the PFD. Two or more connecting straps are secured to the support backing, each strap being adjustable to accomodate various sized PFDs and having at least one free end equipped with fastening elements for securing one or more pouches, mountings, or equipment to the PFD. Preferably the harness is equipped with but not limited to first and second securing straps adapted for fastening to the first and second connecting straps, respectively, and adapted to attach equipment, which is carried in a pouch, to the harness. This equipment may also be on a mounting with electronics devices, communications devices, alert devices or more pouches. This equipment may also be a safety harness.

A second embodiment of the invention provides a personal flotation device having a buoyant body portion, an element for securing the PFD to the body of the wearer, and an element for removably and replaceably attaching equipment. The equipment is preferably carried in a pouch or on a mounting that may be located on one or two sides of the front of the personal flotation device. In one embodiment, the element for removably and replaceably attaching the equipment includes a first fastening portion secured to the PFD at a first point on the buoyant body portion and a second fastening portion secured to the PFD at a second point on the buoyant body portion. Preferably, the element for fastening has a connecting strap and adjustable fastening elements adapted to interlock with complementary fastening elements on components such as a connecting strap, a pouch, or a mounting where these components are at least water resistant and may be buoyant.

In a third embodiment, a personal flotation device having a buoyant portion and an adjustable element for securing the device to the body of the wearer is equipped with a releasable pouch and/or mounting assembly. The pouch assembly is secured to the front of the personal flotation device by a plurality of connecting straps. The first pouch of the pouch assembly is removably and replaceably secured to the personal flotation device by the plurality of connecting straps, each of which is equipped with releasable fasteners and may be enclosed in the sides of the pouch. A second pouch is removeably and releaseably attached to the first pouch by a plurality of releasable fasteners. Preferably, the releasable fasteners comprise a two-part buckle assembly, and the pouch assembly is at least water resistant.

A further embodiment of the invention provides a system for substantially permanently adapting a personal flotation device for attaching equipment thereto. Briefly, the system includes at least a pair of adjustable connecting straps, adapted for substantially permanent attachment to a personal flotation device, fastening elements connected to the connecting straps, a securing strap adapted for fastening between the connecting straps at the fastening elements, and, preferably, at least one pouch. The system can be permanently secured to a variety of collar and vest-type personal flotation devices, among other devices.

The pouches and/or mountings in the preferred embodiments are formed of material which is water resistant, water repellant, and/or buoyant. The releasable fastening element is preferably a two-part buckle assembly which may have a locking function.

DETAILED DESCRIPTION

The present invention, in its several embodiments, provides a harness-type structure for securing equipment, mountings, safety harnesses, or pouches to a personal flotation device, and to other devices as indicated, in a compact, easily accessible system. The invention is adaptable for use with various types of personal flotation devices where the wearer wishes to carry valuables, accessory equipment, or emergency equipment such as a flashlight, shark repellant, compact insulating suit, flares, or distress whistle. Similarly, the system can be used by athletes and sportsmen to allow hands-free storage of, for example, tanning products, fishing tackle, compass, or other gear. Equipment is preferably carried in or on one or more pouches or mountings attached to the system or can be attached to the system directly.

The pouches used in the preferred embodiments of this invention are of fabric and are preferably water resistant, and, most preferably, waterproof. If the proposed contents of the pouch are heavy or especially valuable, it is advantageous for the pouch itself to be buoyant. It is also advantageous to have fastenings inside the pouch to secure equipment.

The invention accordingly has the features of construction, combinations of elements, and arrangements of parts exemplified in the specification and drawings hereinafter set forth, and the scope of the invention is found in the claims.

Figure 1:
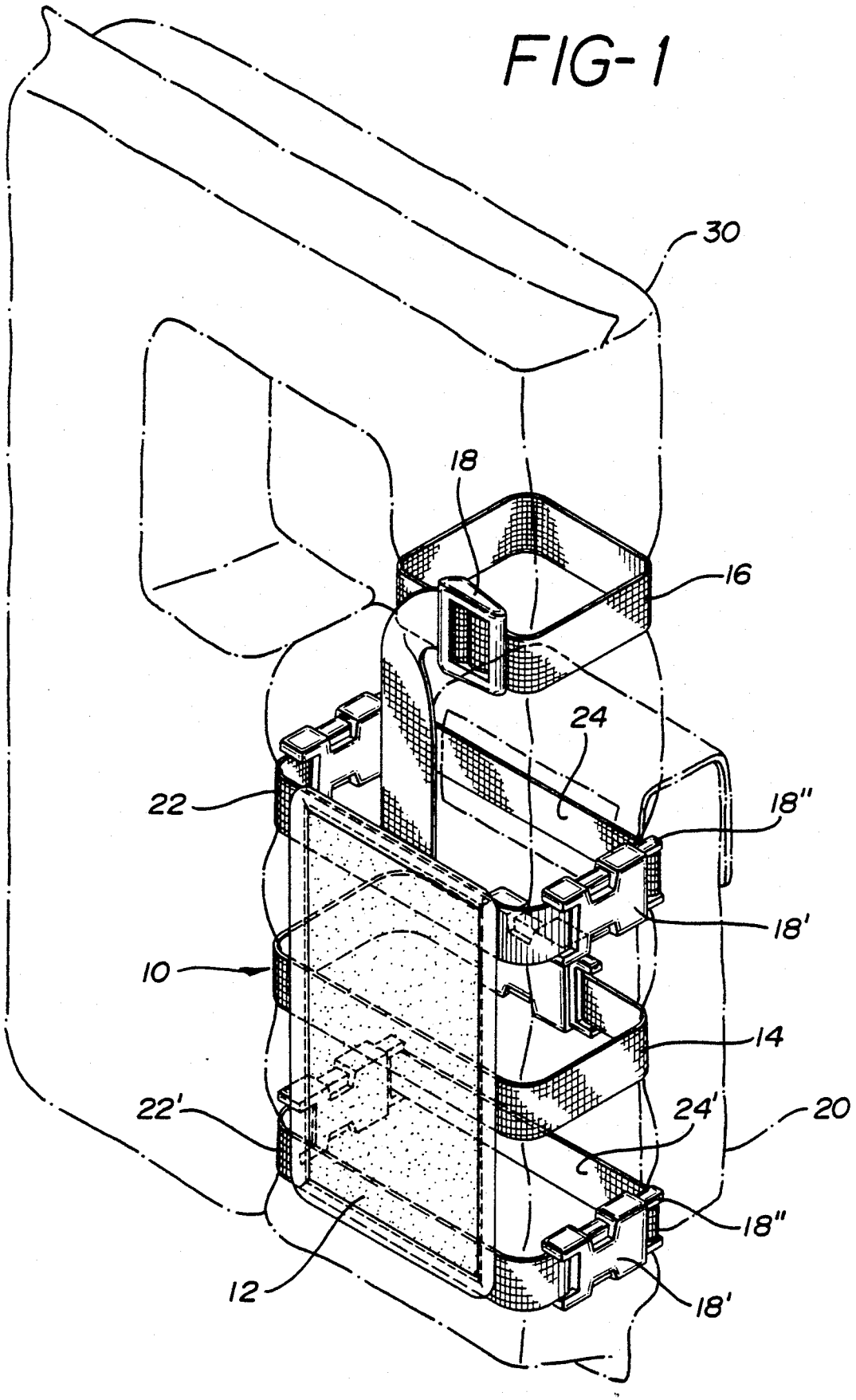
FIG. 1 is a personal flotation device equipped with a harness for attaching a pouch or equipment to the personal flotation device.

Referring now to the drawings, wherein like reference numerals denote like elements throughout the several views, FIG. 1 illustrates a harness 10 for attaching a pouch 20 to a personal flotation device 30, shown here as a Type II device having a central behind-the-neck portion joined between left and right neck-encircling and shoulder and chest overlying portions. The harness 10 has a support backing 12 and an attaching adjustable strap 14 having at least one free end secured to the support backing. The attaching strap 14 is adapted to encircle and fasten about one portion of the personal flotation device 30, such as the Type II personal flotation device shown. The anchoring strap 16 has a first end secured to a normally vertically facing edge, which is preferably facing normally horizontally as shown, of the support backing 12, has an adjustable fastening element 18, and has a second end which encircles the same portion of personal flotation device 30 and is secured therearound by the adjustable fastening element 18. The illustrated fastening element 18 is a single buckle, and other fasteners known in the art are within the scope of the invention, including but not limited to D-rings, hook and loop fasteners, clasps and knots.

A first connecting strap 22, which may be adjustable, is secured to one edge of support backing 12 and has at least one free end equipped with one part of a two-part adjustable fastening element 18' for fastening pouch 20 to harness 10. A second connecting strap 22', which may be adjustable, is secured to a second edge of support backing 12 and is also equipped with fastening element 18' for fastening pouch 20 to harness 10.

As shown in FIG. 1, the pouch or equipment is preferably not attached directly to connecting straps 22 and 22'. Rather, the connecting straps are in turn removably and replaceably attached to securing straps 24 and 24' to which the pouch or equipment is secured. Connecting straps 22 and 22' preferably have two free ends, each equipped with an adjustable fastening element 18' adapted to interfit with compatible fastening element 18'' on securing straps 24 and 24'. Securing straps 24 and 24' are preferably secured to pouch by being threaded through a loop or sleeve on the pouch or by other means known in the art.

Figure 2:
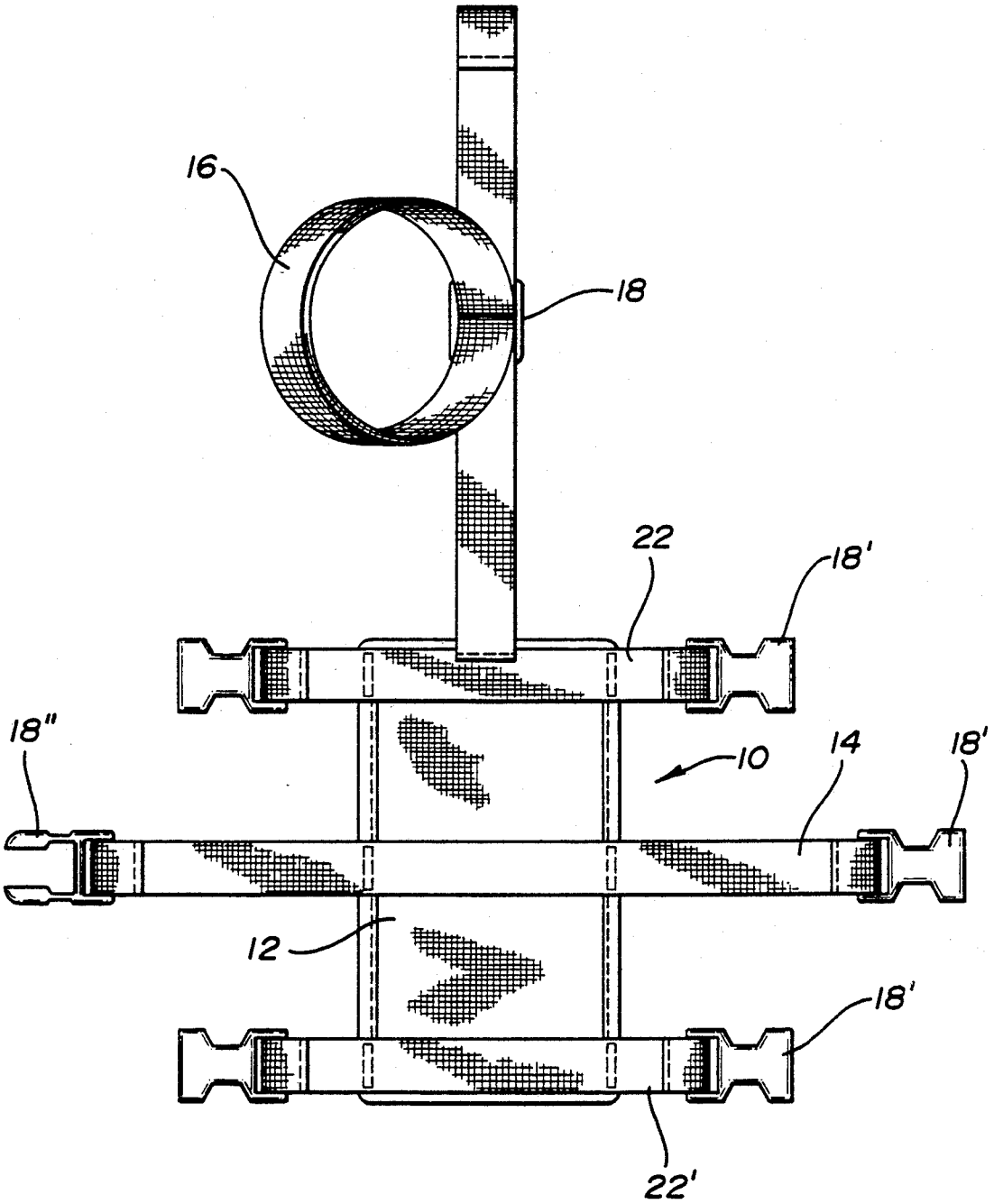
FIG. 2 is the harness for the personal flotation device showing the attaching strap, the anchor strap, the support backing, and the first and second connecting straps.

FIG. 2 is a plan view of the illustrated harness 10, showing support backing 12 bisected by attaching strap 14, and having anchoring strap 16 to one vertically facing end. As shown in the preferred embodiment, attaching strap 14 has two free ends, each equipped with adjustable fastening element 18' and 18''. First and second connecting straps 22 and 22' are secured at opposite, normally horizontal, ends of support backing 12 and are equipped with fastening element 18'.

Harness 10 is preferably made of woven materials capable of withstanding stress without ripping or tearing and which are capable of repelling or shedding water and drying relatively quickly. As shown, the component parts were secured to each other by stitching, but other means of assembling such as adhesives or grommets are contemplated. Support backing 12 is preferably a lightweight, reinforced material such as Goretex and is bounded by a heavy woven reinforcing border to provide strength and prevent unravelling. Straps 14, 16, 22, 22', 24, and 24' are preferably a heavy woven or webbed material having high strength and tensile ability, even when wet. In the preferred embodiment, fastening element 18' and 18'' are two-part buckles with the buckle end 18' attached to the harness and the tab end 18'' attached to pouch 20 or securing straps 24 and 24'.

Figure 3:
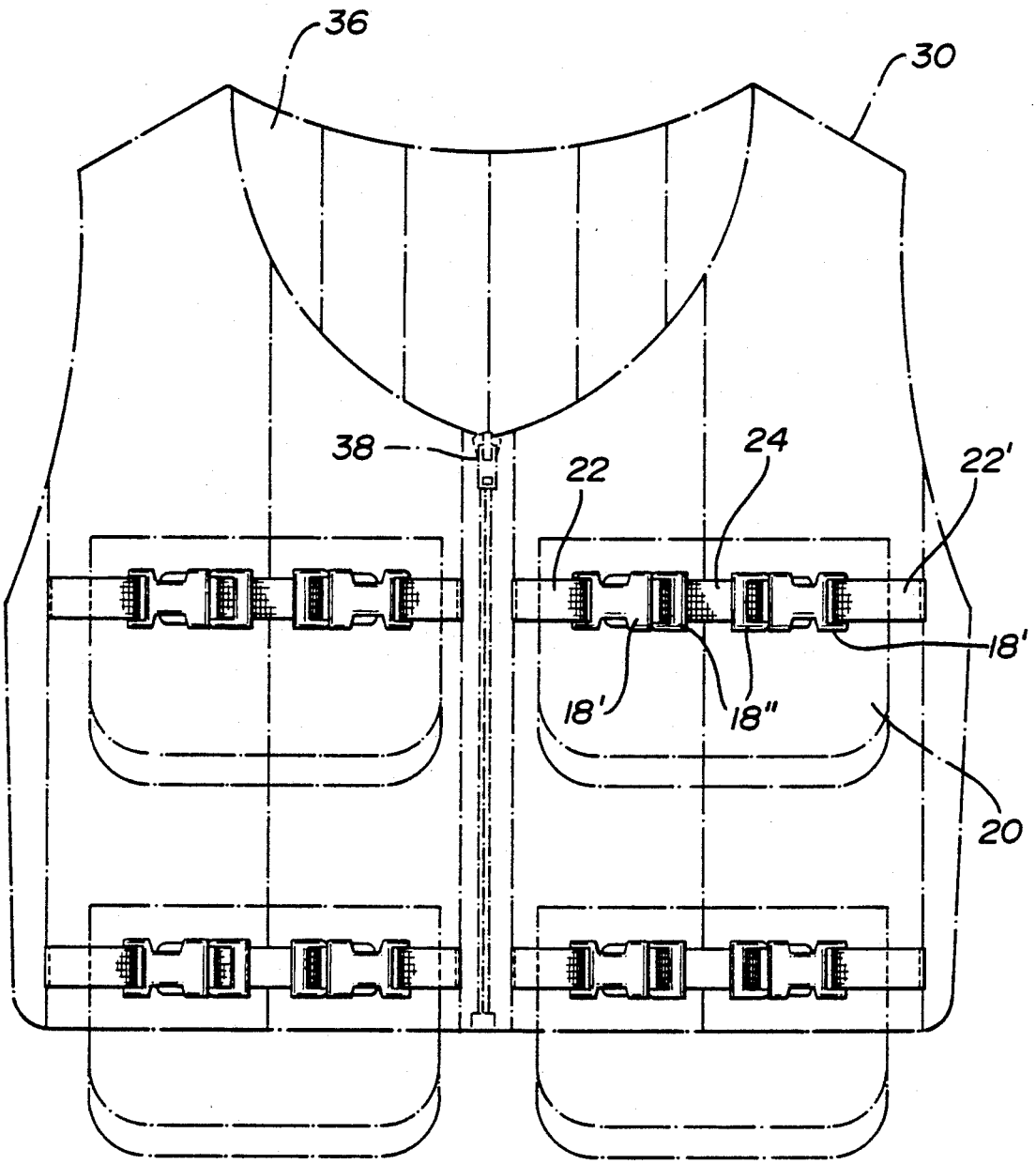
FIG. 3 is a personal flotation device showing the element for removably and replaceably attaching one or more pouches, mountings, or securing straps to one or more sides of the front of the persona flotation device.

FIG. 3 illustrates a vest-type personal flotation device 30 having a buoyant body portion 36, a securing element 38 for securing the device to the body of the wearer, and element for removably and replaceably attaching equipment or a pouch to one side of the front of flotation device 30. The element for attaching has a first connecting strap 22 attached to a personal flotation device 30 at one point on the front, and the second connecting strap 22' secured to the personal flotation device at a second point on the same portion of the device preferably at a point horizontal to the first point. First and second connecting straps 22 and 22' are equipped with adjustable fastening element 18, which is preferably one part 18' of a two-part assembly wherein the second part of the assembly 18'' is attached to securing strap 24. As shown in FIG. 3, a plurality of pouches 20 can be secured to a personal flotation device 30 within easy reach of the wearer. While a Type III personal flotation device is shown here, this embodiment can be adapted for use with any type of personal flotation device. The pouches can be removed or added as needed. Optionally, pouch 20 can be removed, leaving securing strap 24, thereby allowing attachment of equipment or devices which would not fit in a pouch, or are adapted to be secured by a clip or secured to a mounting.

Straps 22, 22', and 24 are preferably made of a heavy woven or webbed material having high strength and tensile ability, even when wet. As shown in FIG. 3, fastening element 18' and 18" are preferably the buckle and tab portions of a buckle assembly, but other releasable fastening elements known in the art such as D-rings, clasps, knots, and hook and loop assemblies are contemplated.

Figure 4:
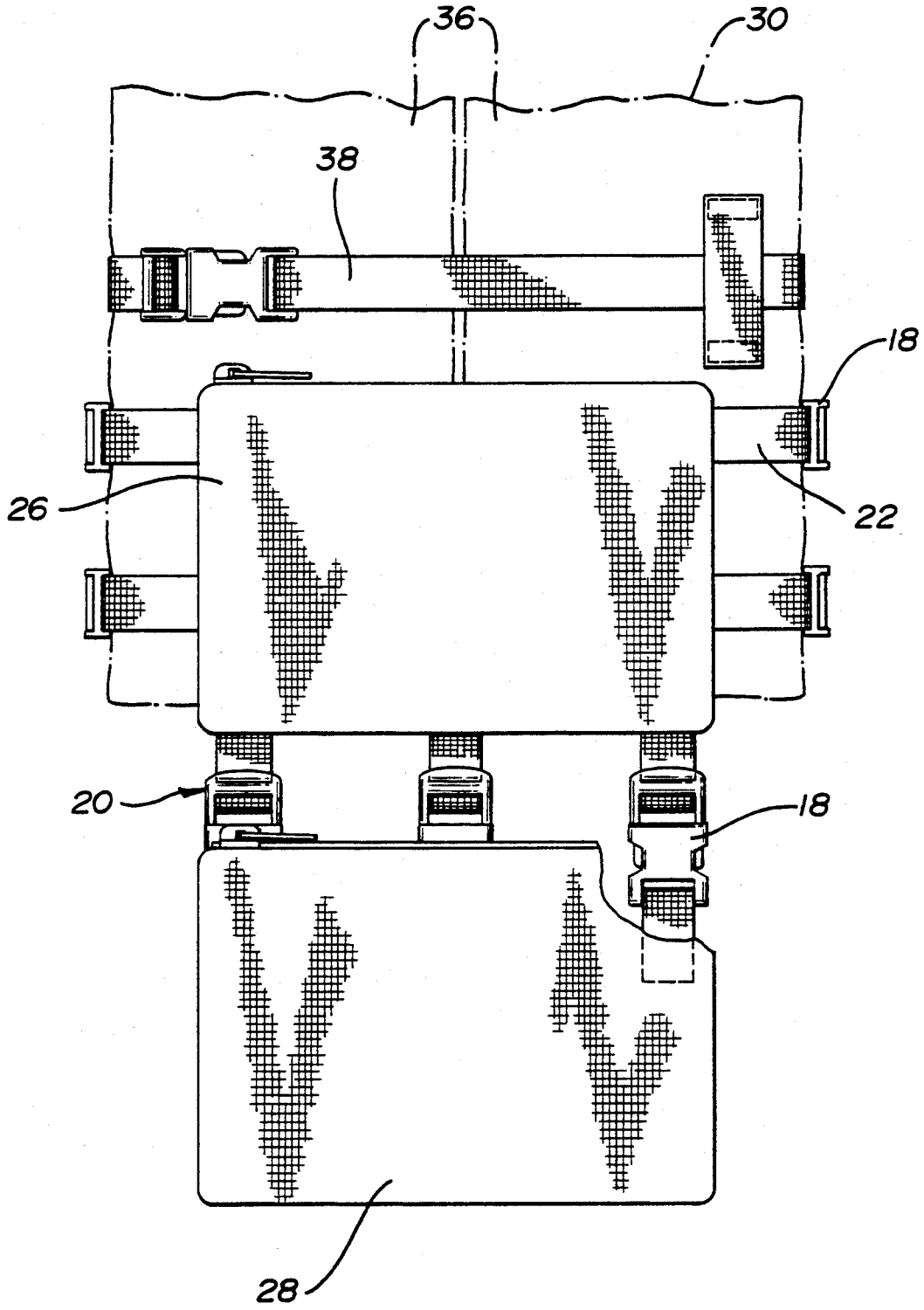
FIG. 4 shows a personal flotation device equipped with a releasable pouch assembly on the front of the device.
Figure 5:
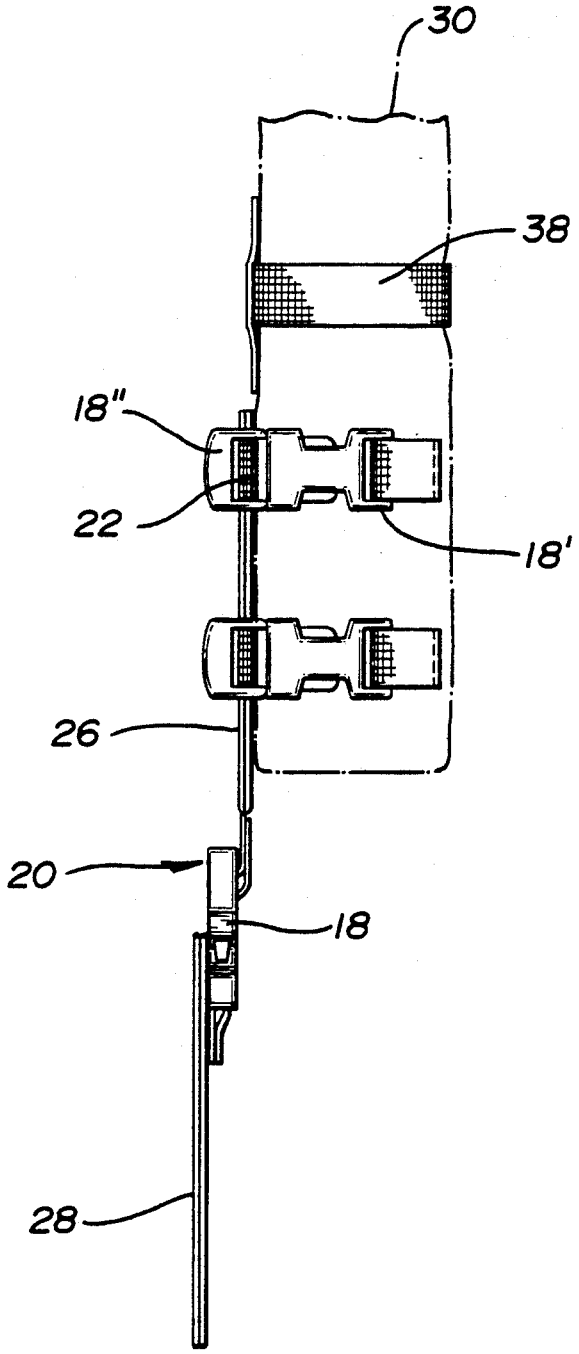
FIG. 5 is a side view of the releasable pouch assembly of FIG. 4.

FIGS. 4 and 5 illustrate a personal flotation device 30 having a body portion 36 and an adjustable securing element 38 for securing the device to the body of the wearer. Personal flotation device 30 is equipped with a removable and replaceable pouch assembly 20, the pouch assembly having at least two pouches 26 and 28, secured to the personal flotation device by a plurality of connecting straps 22 secured to the PFD and adapted for fastening the pouch assembly to the PFD. Pouch assembly 20 is fastened to the personal flotation device by attaching straps 22 at adjustable fastening elements 18. Preferably, as shown in FIG. 5, adjustable fastening element 18 is a two-part assembly 18' and 18" where fastening element 18" is secured to the sides of personal flotation device 30, and adjustable fastening element 18' is secured to strap 22, thereby allowing the wearer to adjust tension on straps 22 to prevent the pouch assembly 20 from sagging. Pouch assembly 20 has at least a first pouch 26 attached to a second pouch 28 by a plurality of adjustable, removable and replaceable fasteners 18. As disclosed above, fastening element 18 is preferably a two-part buckle assembly, but may also include elements known in the art, such as hook and loop fasteners, D-rings, clasps, knots, and other devices for removable and replaceable attachment that are capable of withstanding exposure to water.

Pouch assembly 20 is preferably made of woven materials capable of resisting or repelling water and is most preferably buoyant. Straps 22 are a woven or webbed material having high strength and tensile ability. As shown, straps 22 are secured to pouch assembly 20 and to personal flotation device 30 by stitching, but other permanent securing methods such as adhesives and grommets are within the scope of the invention.

In a further embodiment, a system is provided for substantially permanently adapting a personal flotation device for attaching equipment thereto. Briefly, the system includes at least a pair of connecting straps adapted for substantially permanent attachment to a personal flotation device, fastening elements attached to the connecting straps, a securing strap adapted for fastening between the pair of connecting straps at the fastening elements, and, preferably, at least one pouch. This system can be permanently secured to a variety of types of personal flotation devices in configurations similar to those shown in FIGS. 3–5.

The system for substantially permanently adapting a personal flotation device has a pair of connecting straps 22, each equipped with a releasable fastener 18 at one end. The opposing end will be permanently attached to the personal flotation device by stitching, adhesives, or other methods known in the art. The placement of the straps is left to the wearer's discretion and is dependent on accessibility and size and shape of the equipment generally to be carried. Once the connecting straps are attached, a securing strap 24 is fastened therebetween. If a pouch 20 is to be carried, securing strap 24 is preferably threaded through a loop on the pouch 20, or pouch 20 can be integral with securing strap 24.

The pouch is preferably buoyant and waterproof. The straps are a heavy webbed or woven material, and the releasable fastening device is preferably a two-part buckle assembly.

Having described the invention, what is claimed as new and secured by Letters Patent is:

1. Harness apparatus for attaching equipment to a personal flotation device having left and right shoulder and chest-overlying portions, said harness apparatus comprising a support backing having a first edge facing a normally vertical direction, and opposed second and third edges extending transversely to said first edge, an adjustable attaching strap secured to said support backing, said strap adapted to encircle and fasten about any one of the left and right portions of a personal flotation device, an anchoring strap having a first end secured to a normally vertical edge of said support backing, an adjustable fastening means, and a second end, said anchoring strap being arranged for encircling the same portion of a personal flotation device that said attaching strap encircles and for being secured therearound by said adjustable fastening means, a first connecting strap secured to one edge of said support backing, said first connecting strap having a free end equipped with an adjustable fastening means adapted for attaching equipment to said harness, and a second connecting strap secured to a further edge of said support backing, said second connecting strap further comprising a free end equipped with an adjustable fastening means adapted for attaching equipment to said harness, whereby the equipment can connectingly attach to the personal flotation device by engagement with any one of said first and second connecting straps.

2. Harness apparatus according to claim 1 further comprising an equipment-carrying pouch, mounting, or a safety harness adapted for removable and replaceable fastening to said first connecting strap.

3. Harness apparatus of claim 1 further comprising a first securing strap adapted for fastening to said first connecting strap, and a second securing strap adapted for fastening to said second connecting strap, said first and second securing straps each being further adapted for removably and replaceably attaching the equipment to said harness.

4. Harness apparatus of claim 3 further comprising an equipment-carrying pouch, mounting, or a safety harness having securing means adapted for fastening said pouch, mounting, or safety harness to said first securing strap.

5. Harness apparatus of claim 2 wherein said pouch is water resistant and buoyant.

6. Harness apparatus of claim 1 further comprising a second anchoring strap having a first end secured to a normally vertical edge of said support backing, an adjustable fastening means, and a second end, said second anchoring strap being arranged for encircling the same portion of a personal flotation device that said attaching strap encircles and for being secured therearound by said adjustable fastening means thereof.

7. Harness apparatus for attaching equipment to a collar-type personal flotation device having a central behind-the-neck portion joined between right and left neck-encircling and shoulder and chest-overlying portions, said harness comprising a support backing having a first edge facing in a normally vertical direction, and opposed second and third edges extending transversely to said first edge, an adjustable attaching strap secured to said support backing, said strap adapted to encircle and fasten about any one of the left and right portions of a personal flotation device, an anchoring strap having a first end secured to a normally vertically facing edge of said support backing, an adjustable fastening means, and a second end, said anchoring strap being arranged for encircling the same portion of a personal flotation device that said attaching strap encircles, and for being secured therearound by said adjustable fastening means, a first connecting strap secured to one edge of said support backing, said first connecting strap having a free end equipped with an adjustable fastening means adapted for attaching equipment to said harness, and a second connecting strap secured to a further edge of said support backing, said second connecting strap further comprising a free end equipped with an adjustable fastening means adapted for attaching equipment to said harness, whereby the equipment connectingly attaches to the personal flotation device by engagement with any one of said first and second connecting straps.

8. Harness apparatus according to claim 7 further comprising an equipment-carrying pouch, mounting, or a safety harness adapted for removable and replaceable fastening to said first connecting strap.

9. Harness appartus of claim 8 wherein said pouch and mounting is water resistant and buoyant.

10. Harness apparatus of claim 7 further comprising a first securing strap adapted for fastening to said first connecting strap, and a second securing strap adapted for fastening to said second connecting strap, said first and second securing straps further adapted for removably and replaceably attaching the equipment to said harness.

11. Harness apparatus of claim 10 further comprising an equipment-carrying pouch, mounting, or safety harness having securing means adapted for fastening said pouch, mounting, or safety harness to said first securing strap.

12. A system for substantially permanently adapting a personal flotation device for attaching equipment thereto, wherein said personal flotation device has a buoyant body Portion having left and right shoulder and chest-overlying portions, said system comprising a pair of connecting straps adapted for substantially permanent connection to the buoyant body portion of a personal flotation device, each strap having a first end equipped with removable and replaceable fastening means and a second end adapted for substantially permanent attachment at a selected location on the buoyant body portion of a personal flotation device, and a securing strap, adapted for fastening to a connecting strap, said securing strap having first and second ends, each equipped with releasable fastening means adapted to interfit with said removable and replaceable fastening means on said connecting strap, said securing strap being further adapted for removably and replaceably attaching equipment to the personal flotation device.

13. The system of claim 12 further comprising an equipment-carrying pouch or mounting having securing means adapted for fastening said pouch or mounting to said securing strap.

14. The system of claim 13 wherein said pouch and mounting is water resistant and buoyant.

15. A personal floatation device comprising: a buoyant body portion having a front and a back and having left and right shoulder and chest-overlying portions, means for securing said device to the body of the wearer, means for removably and replacably attaching equipment to one side of the front said personal floatation device, wherein said means for attaching comprises a first fastening portion and a second fastening portion, said first fastening portion being secured to any one of said left and right portions of said floatation device at a first location thereon, and said second fastening portion being secured to the same portion of said personal floatation device at a second location thereon, and a securing strap adapted for fastening to said first and second fastening portions, said securing strap further adapted for removably and replacably attaching equipment to said personal floatation device.

16. The personal floatation device of claim 15 wherein each of said first and second fastening portions comprises a connecting strap and adjustable fastening means.

17. The personal floatation device of claim 15 further comprising an equipment-carrying pouch, mounting, or saftey harness having securing means adapted for fastening said pouch, mounting, or saftey harness to said personal floatation device.

18. The personal floatation device of claim 17 wherein said pouch is water resistant and buoyant.

19. Personal floatation device of claim 15 wherein said first fastening portion and said second fastening portion comprises a buckle fastener.

20. Personal floatation device of claim 15 wherein said first fastening portion and said second fastening portion comprises a D-ring fastener.

21. Personal floatation device of claim 15 wherein said first fastening portion and said second fastening portion comprises a hook and loop fastener.

22. Personal floatation device of claim 15 wherein said first fastening portion and said second fastening portion comprises a clasp and knot fastener.

23. The personal floatation device of claim 15 wherein a first pouch or mounting is removably and replacably attached to said personal floatation device by means of said securing straps, and a second pouch or mounting removably and replacably attached to said first pouch by releasable fastening means.

24. The personal floatation device of a claim 23 wherein said pouch assembly is water resistant and buoyant.

25. The personal floatation device of claim 23 wherein each said releasable fastening means comprises a two-part buckle assembly that may be locked.

26. The personal floatation device of claim 23 wherein said plurality of releasable fastening means is secured to said second pouch or mounting and arranged thereon to attach said second pouch or mounting below said first pouch or mounting.

* * * * *